US008244499B2

(12) United States Patent
Lambie et al.

(10) Patent No.: US 8,244,499 B2
(45) Date of Patent: Aug. 14, 2012

(54) METHODS AND SYSTEMS FOR MANAGING AQUIFER OPERATION

(75) Inventors: John M. Lambie, Portland, OR (US); John E. Dustman, Minnetonka, MN (US)

(73) Assignee: Aquifer Resource Management, Inc., Saint Paul, MN (US)

( * ) Notice: Subject to any disclaimer, the term of this patent is extended or adjusted under 35 U.S.C. 154(b) by 549 days.

(21) Appl. No.: 12/363,339

(22) Filed: Jan. 30, 2009

(65) Prior Publication Data

US 2010/0193183 A1 Aug. 5, 2010

(51) Int. Cl.
*G06F 11/30* (2006.01)
*G21C 17/00* (2006.01)

(52) U.S. Cl. ..... 702/182; 702/183; 702/184; 702/185

(58) Field of Classification Search ..... 702/50–55, 702/100–102, 181–189
See application file for complete search history.

(56) References Cited

U.S. PATENT DOCUMENTS 5,271,467 A * 12/1993 Lynch ..... 166/370
6,542,827 B1 * 4/2003 Koster ..... 702/22

* cited by examiner

*Primary Examiner* — Phuong Huynh
(74) *Attorney, Agent, or Firm* — Alleman Hall McCoy Russell & Tuttle LLP

(57) ABSTRACT

Systems and methods for managing aquifer operation are included. An exemplary method includes receiving at an analysis computing device, one or more water measurements from a plurality of sites in an aquifer, wherein water measurements are received at a plurality of time points. A site may include one or more groundwater extraction wells. The method may further include calculating well operational data for at least one groundwater extraction well based on the water measurements, wherein the well operational data includes a well efficiency over a time period. Further, the method may include receiving an aquifer objective input via a graphical user interface presented on the analysis computing device. The method may further include generating a pump operation signal based on the well operational data and the aquifer objective input.

18 Claims, 11 Drawing Sheets

METHODS AND SYSTEMS FOR MANAGING AQUIFER OPERATION

BACKGROUND

Managing the operation of multiple wells in a well field of an aquifer is a difficult task. Competing environmental, equipment, and energy costs factor in to each operation decision for each well. However, it is difficult to predict how the wells will interact with each other, and with wells of other well fields that may draw from the same aquifer. Further, it is difficult to predict how the aquifer itself will respond to variations in well pumping operations at different locations in the well field. It is also difficult to predict how pumps will perform under changing aquifer conditions. To address these difficulties, much reliance has been placed on the knowledge acquired by well operators who have manually operated the pumps of a particular well field over years of changing aquifer conditions. While these approaches may have sufficed in the past, overreliance on human judgment can produce inefficiencies in operation, increased energy and equipment costs, and even damage to the aquifer. The inventors have recognized that data driven approaches to managing aquifer operation are needed to complement the judgment of human well operators.

SUMMARY

Systems and methods for managing aquifer operation are provided. One example method includes receiving at an analysis computing device, one or more water measurements from a plurality of sites in an aquifer. The water measurements are received at a plurality of time points, and a site includes one or more groundwater extraction wells. The method may further include calculating well operational data for at least one groundwater extraction well based on the water measurements, wherein the well operational data includes a well efficiency over a time period. Further, the method may include receiving an aquifer objective input via a graphical user interface presented on the analysis computing device, and generating a pump operation signal based on the well operational data and the aquifer objective input.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

FIG. 8*b* illustrates an exemplary potentiometric surface graph where contour lines delineate areas associated with differing drawdown values, when a selected well is turned on.

DETAILED DESCRIPTION

Figure 1:
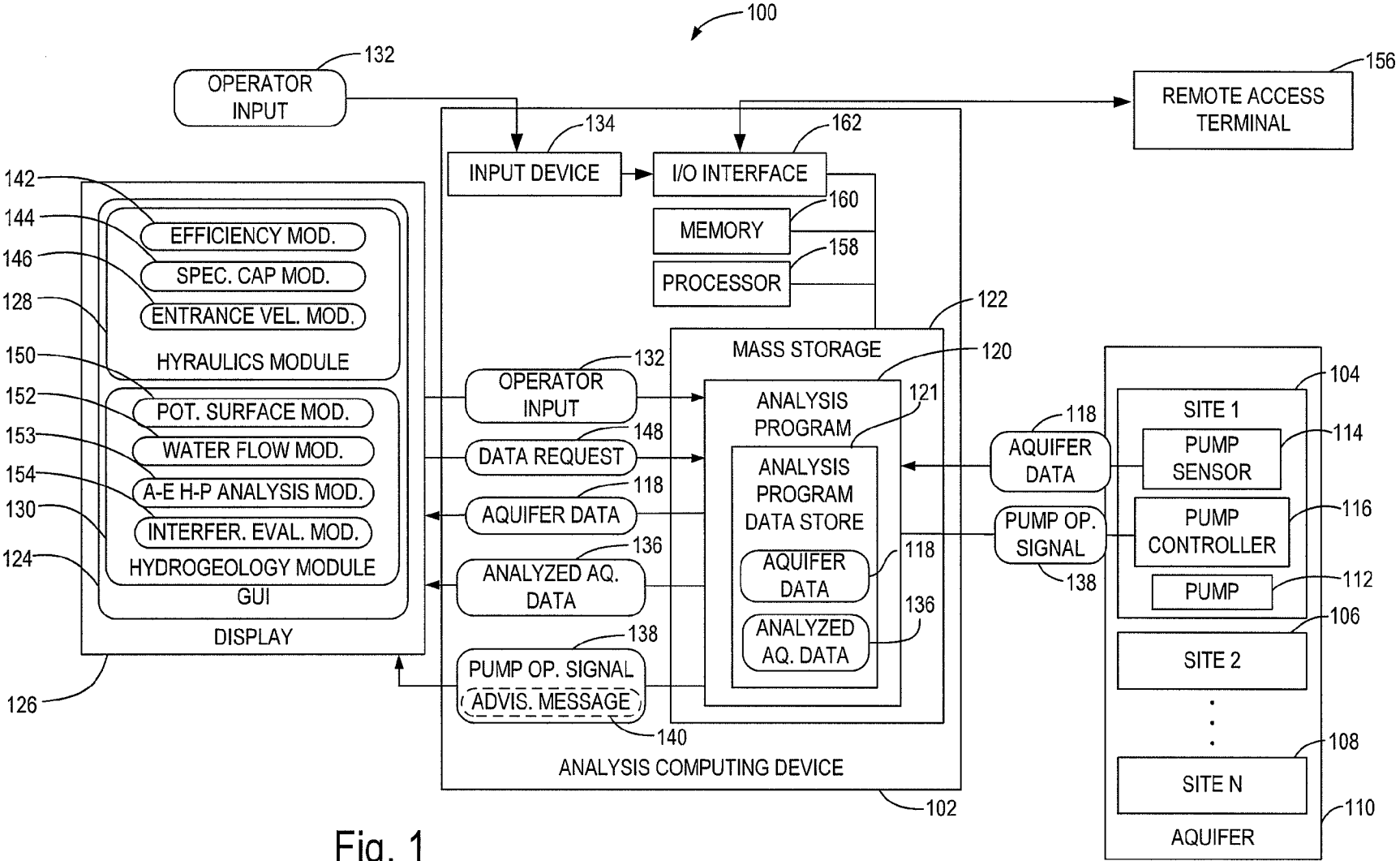
FIG. 1 is a schematic view of a system for managing aquifer operation.

FIG. 1 is a schematic view of an exemplary system 100 for managing aquifer operation. The system 100 includes an analysis computing device 102 in communication with site 1 104, site 2 106, and site N 108 of an aquifer 110. The system 100 may be in communication with any number of sites. The sites 104, 106, 108 may include one or more groundwater extraction wells (e.g., a pump 112), and/or one or more observation wells, and may further include an associated pump sensor 114 (e.g., for observation) and pump controller 116 (e.g., for adjusting pump operation). In some examples, a groundwater extraction well is designated as an observation well, as will be described later. The analysis computing device 102 is configured to receive aquifer data 118 including one or more water measurements from a plurality of sites 104, 106, 108 over a time interval. The analysis computing device 102 can then perform analyses on the aquifer data (e.g., water measurements) 118, for example by an analysis program 120 located in a mass storage 122 of the analysis computing device 102. As some examples, water measurements can include water flow, water pressure, and/or water level.

Aquifer data 118 and analyzed aquifer data 136 (e.g., well operational data, modeled data) may be output from the analysis program 120, and/or stored in an analysis program data store 121, for later retrieval and downstream processing by the analysis program 120 and/or other applications such as a geographical rendering system, etc. Thus, a pump operation signal 138 can be sent to a display 126 and/or sites in the aquifer 110, as will be described with more detail with respect to FIG. 2.

The system 100 also includes a graphical user interface (GUI) 124 presented on a display 126 associated with the analysis computing device 102. The graphical user interface 124 may itself include a well hydraulics module 128 and a hydrogeology module 130. Accordingly, the well hydraulics module 128 may graphically present hydraulics data, and the hydrogeology module 130 may graphically present hydrogeological data. It may be appreciated that the GUI 124 and the modules contained therein may also textually and otherwise present preprocessed aquifer data 118 and analyzed aquifer data 136.

The GUI 124 may receive operator input 132 via an input device 134, which may be a keyboard, mouse, touch screen, etc., and send the operator input 132 to the analysis program 120 of the analysis computing device 102. The GUI 124 can also display aquifer data 118 received from the analysis computing device 102, and display analyzed aquifer data 136 received from the analysis computing device 102. Furthermore, the GUI 124 may display a pump operation signal 138 received from the analysis program 120 of the analysis computing device 102. In some examples, the pump operation signal 138 may include a pump operation advisory message 140, which can be displayed. In one specific example, a plurality of advisory messages of varying priority levels, such as a high, medium, and low priority, may be indicated by numbers, colors (red, yellow, and green), etc. on the GUI. These advisory messages 140 may advise a well operator regarding operation of a pump or site exceeding a performance threshold set by operator input 132 or otherwise stored within the analysis program 120. For example, if a pump is operating below a threshold efficiency, or an aquifer is drawn below a threshold level, then an advisory message indicating this information may be displayed.

It may be appreciated that the display 126 associated with the analysis computing device 102 may be located outside of the analysis computing device 102, and/or integrated with the analysis computing device 102.

Each of a plurality of modules (142, 144, 146, 150, 152, 154), contained in hydraulics module 128 and the hydrogeology module 130, and described in detail below, may display analysis options to an operator, and may also allow the operator to interact with the GUI 124.

Referring now to the hydraulics module 128, it may include modules associated with well operational data. For example, an efficiency module 142, a specific capacity module 144, and an entrance velocity module 146. Specifically, the efficiency module 142 may be configured to receive efficiency operator input including one or more selected groundwater extraction wells and a time interval. The efficiency module 142 may send a well operational data request (e.g., a data request 148) to the analysis computing device 102, and receive well operational data (which is a form of analyzed aquifer data 136) from the analysis computing device 102 in response. Thus, the efficiency module 142 can display the well operational data, and/or send the well operational data into a data storage for future analysis of well operational data at another time interval. The well operational data may include well efficiency, aquifer-water pressure loss, well-water pressure loss, specific capacity, entrance velocity, and one or more critical water levels for the one or more selected groundwater extraction wells, for example. The critical water levels may be, for example, a water level at which cavitation on the pump impeller occurs, or a level at which the pump intake runs dry, for example.

Well efficiency of one or more selected groundwater extraction wells can be calculated over a time interval at the analysis computing device 102, by calculating an intermediate well efficiency, executing an interference evaluation of at least one additional groundwater extraction well with the selected groundwater extraction well(s), and modifying the intermediate well efficiency based on the interference evaluation from the at least one additional groundwater extraction well. By doing this, the well efficiency can more closely represent actual well efficiency absent any interference effects that may be occurring between sites. Calculation of well operational data will be described in more detail with respect to FIG. 2.

Another module included in the well hydraulics module 128 of the GUI 124 is the specific capacity module 144. The specific capacity module 144 may receive specific capacity operator input including one or more selected groundwater extraction wells for the analysis, a static water level, an interference water level, and a pumping water level. The specific capacity module 144 can send specific capacity operator input to the analysis program 120 of the analysis computing device 102, and also send a data request 148 for a calculated specific capacity. At the analysis computing device, a specific capacity of one or more groundwater extraction wells can be calculated over a time interval by calculating an intermediate specific capacity, executing an interference evaluation of at least one additional groundwater extraction well, and modifying the intermediate well efficiency based on the interference evaluation of the at least two groundwater extraction wells. By including an interference evaluation with a specific capacity calculation, the groundwater extraction wells' specific capacity can more closely represent actual well specific capacity, absent any interference effects that may be occurring due to operation of one or more additional groundwater extraction well operating simultaneously. Thus, the specific capacity module 144 can receive a calculated specific capacity (which is a form of analyzed aquifer data 136) for the one or more selected groundwater extraction wells from the analysis computing device 102 in response to the data request 148. Accordingly, the specific capacity module 144 can display the calculated specific capacity for the one or more selected groundwater extraction wells, and/or send the calculated specific capacity data into data storage for future analysis of groundwater extraction well specific capacity for another time interval.

A third module, the entrance velocity module 146, may be included in the well hydraulics module 128. The entrance velocity module 146 may be configured to receive entrance velocity operator input including one or more selected groundwater extraction wells and selected groundwater extraction well parameters. The entrance velocity module 146 can also send an entrance velocity request (e.g., data request 148) to the analysis computing device 102, and receive an entrance velocity (e.g., analyzed aquifer data 136) for the one or more selected groundwater extraction wells, from the analysis computing device 102. Accordingly, the entrance velocity module 146 can display the entrance velocity for the one or more selected groundwater extraction wells, and/or send the entrance velocity data into data storage for future analysis of entrance velocity for another time interval. An advisory message may be displayed that indicates to a well operator that the entrance velocity exceeds a predetermined threshold, and a recommendation may be displayed to lower the pumping rate. A selector may be presented to the well operator to proceed and take the recommended action of lowering the pumping rate, for example.

Turning now to the hydrogeology module 130 of the GUI 124, it may include one or more geostatistical modeling modules configured to display aquifer-water pressure data including elevation units, and apply one or more geostatistical models to the aquifer-water pressure data. The geostatistical modeling module may be a potentiometric surface module 150, a water-flow modeling module 152, an aquifer-extraction hydraulic-parameters analysis module 153 and/or an interference evaluation module 154. It may be appreciated that the geostatistical models described herein may also be applied to other water measurements.

The potentiometric surface module 150 may receive potentiometric surface operator input including a plurality of sites (e.g., observation wells), and a time interval. Further, a desired geostatistical interpolation method including a linear-log kriging method, an inverse-distance weighted method, a spline method (e.g., cubic spline), a universal kriging method, and/or an ordinary kriging method can be received as potentiometric surface operator input at the potentiometric surface module 150. Thus, the potentiometric surface module 150 can send the potentiometric surface operator input to the analysis computing device 102, receive a potentiometric surface model from the analysis computing device 102 based on the potentiometric surface operator input, and display the potentiometric surface model in a geographic rendering system in two or three dimensional form, for example. The geographic rendering system may be incorporated into GUI 124, or may be a separate geographic information system (GIS) application executed on the analysis computing device 102, for example.

Turning now to the water-flow modeling module 152 of the hydrogeology module 130, it is configured to receive water-flow modeling operator input including one or more of a selected groundwater extraction well, a location of water-flow traces, a number of water-flow traces, and a starting point for each water-flow trace from the GUI 124. In one example, these water-flow traces are particle tracking traces. The water-flow modeling module 152 may also receive an aquifer transmissivity input from one or more of the graphical user interface and the analysis computing device, and send the water-flow modeling operator input and the aquifer transmissivity input to the analysis computing device 102. In response, the water-flow modeling module 152 can receive a groundwater extraction well capture zone analysis in the analyzed aquifer data 136, from the analysis computing device 102. The groundwater extraction well capture zone analysis can include modeled water-flow traces for the one or more selected groundwater extraction wells based on the water-flow modeling operator input and the water transmissivity input. Further, the water-flow modeling module 152 may display the modeled water-flow traces, wherein the modeled water-flow traces are computed based on an interpolated pressure field, the water-flow modeling operator input, and the water transmissivity input, as some examples.

The interference evaluation module 154 is yet another geostatistical modeling module which may be presented in the hydrogeology module 130 of the GUI 124. The interference evaluation module 154 may receive interference operator input including at least two groundwater extraction wells, and send the interference operator input to the analysis computing device 102. In response, the interference evaluation module 154 can receive an interference evaluation from the analysis computing device 102 based on the interference operator input, and graphically display the interference evaluation. Further, the interference evaluation data can be stored in the mass storage 122 for future analysis.

It may be appreciated that additional terminals, such as a remote access terminal 156 can be connected to the analysis computing device 102, and can operate similarly to the analysis computing device 102, in that it can display the graphical user interface to a user over a computer network. That is, the remote access terminal 156 can receive aquifer data from the aquifer, and operator input, aquifer data, and analyzed aquifer data from the analysis computing device 102. Further, the GUI 124 can display aquifer data via the remote access terminal 156. Further still, the GUI 124 can display analyzed aquifer data received from the remote access terminal 156, and display a pump operation advisory message 140 via the remote access terminal. A remote access terminal may be an additional computing device, a display screen, a router, etc., and may be connected over a computer network (e.g., LAN or WAN such as the Internet).

With regard to the hardware employed in system 100, the analysis program 120 and other programs of analysis computing device 102 may be stored in the mass storage 122 and executed on a processor 158 using portions of memory 160 and may further be configured to communicate with software programs on other computing devices, such as the remote access terminal 156 across one or more computer networks, and the input device 134 via input/output interface 162. Display 126 may also be configured to receive display output from the analysis program 120 via the input/output interface 162. It will further be appreciated that the analysis computing device 102 may be a single computing device or server, or multiple distributed computing devices and/or servers interoperating across one or more computer networks, and the components of the analysis program 120 may be implemented on these distributed devices.

Figure 2:
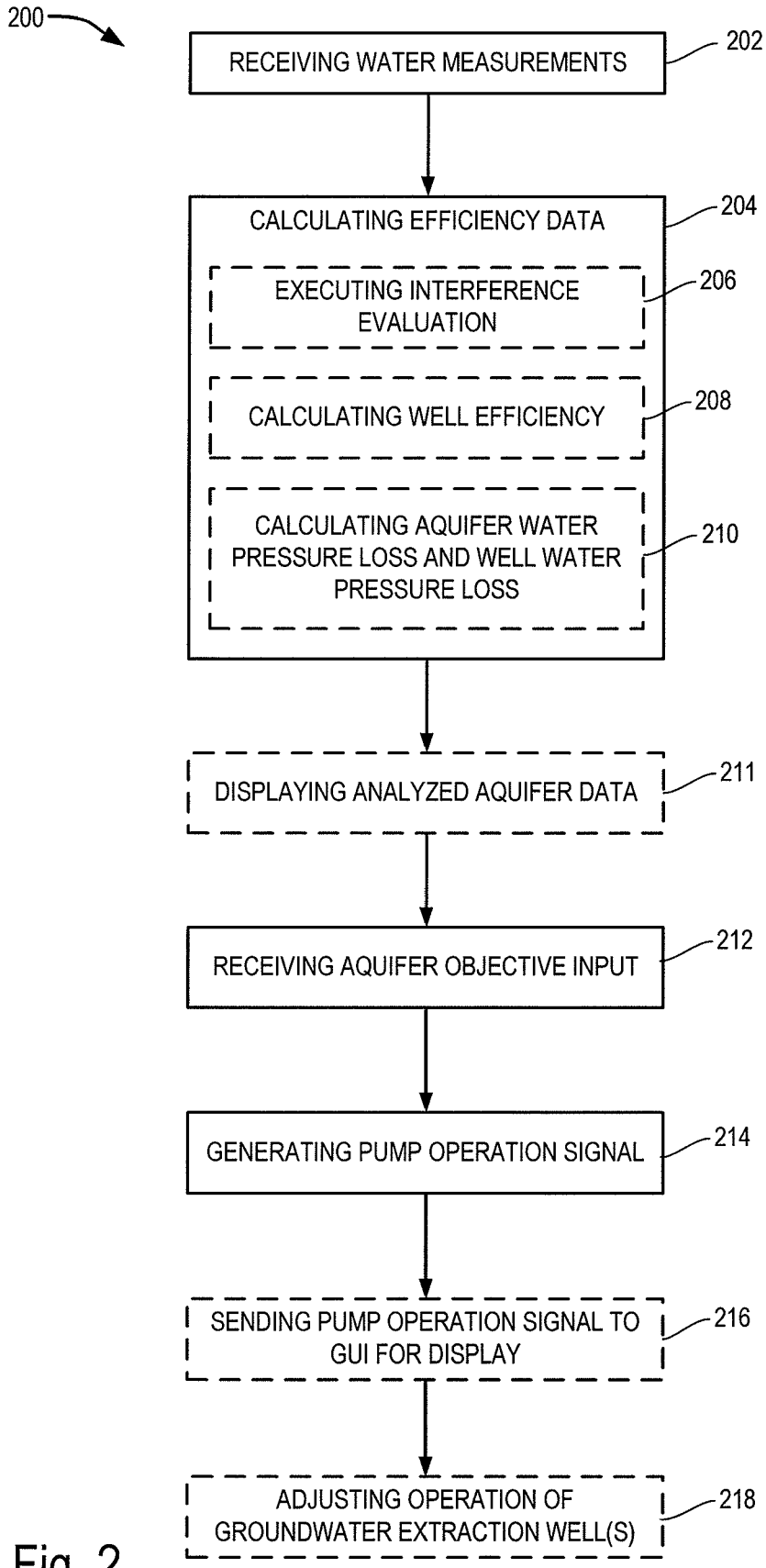
FIG. 2 is a flowchart illustrating an exemplary method for managing aquifer operation.

Turning now to FIG. 2, a flowchart illustrates a method 200 for managing aquifer operation. At 202, the method includes receiving, at an analysis computing device, one or more water measurements from a plurality of sites in an aquifer. The water measurements may be continuously or periodically monitored, being received at an analysis computing device, at a plurality of time points. In one example, the plurality of time points may be a plurality of time points collected according to a predetermined schedule (e.g., three times a day at specified hours, seven days a week, etc.) such that the water measurements are continuously monitored. In another example, the plurality of time points may include a series of water measurements collected in response to a change in one or more water measurements exceeding an associated threshold. For example, it may be desirable to monitor the water measurements of a site more frequently if there is a change in one or more aquifer conditions, such as: a water level above a level threshold, a water pressure above a pressure threshold, an electrical conductivity above a conductivity threshold, a water temperature above a temperature threshold, and a vibration parameter above a vibration threshold. Further still, there may be low thresholds for which values below the low thresholds trigger a collection of water measurements for a plurality of time points. It may be appreciated that water measurements may be collected responsive to predefined changes in aquifer conditions as described above, in addition to being collected at a predetermined schedule.

At 204, the method 200 includes calculating well operational data for at least one groundwater extraction well based on the water measurements. Calculating the well operational data may optionally include executing, at 206, a well hydraulic interference evaluation of at least two groundwater extraction wells, based on geographic reference coordinates. Calculating the well hydraulic interference evaluation at 206 may include calculating an interference measurement based on a number of operator inputs received from the graphical user interface, as will be discussed with reference to FIG. 3.

Well operational data can include well efficiency, aquifer-water pressure loss, and/or well-water pressure loss, among other measures of well performance. Thus, calculating well operational data may include calculating well efficiency at 208 for each groundwater extraction well based on associated interference evaluations and a number of efficiency operator inputs received at a graphical user interface associated with the analysis computing device. Likewise, the calculating of the well operational data may include calculating aquifer-water pressure loss and/or well-water pressure loss at 210, for a plurality of sites. As mentioned above, the well operational data may be calculated over a time period, such as a number of seconds, minutes, days, weeks, etc.

After calculating the well operational data at 204, it will be appreciated the results of the calculation may be stored in an analysis program data store for later retrieval and downstream processing.

At 211, analyzed aquifer data can be graphically displayed, as measurements over a time interval, to inform an operator of current aquifer operation parameters and measurements compared to historical aquifer operation parameters and measurements. In some examples, the analyzed aquifer data is displayed prior to setting or changing an aquifer objective input, and prior to generating a pump operation signal at 212 or sending a pump operation signal at 214, as described below.

At 212, the method 200 includes receiving an aquifer objective input from, or via, a graphical user interface presented on an analysis computing device. An aquifer objective input may be an optimal energy consumption, an optimal groundwater elevation for each groundwater extraction well, an optimal pressure reading for each groundwater extraction well, an optimal water pumping volume, a site contamination avoidance for a selected site and/or a groundwater contamination removal for the aquifer. These aquifer objective inputs can be pre-set upon configuration of the system, and can further be pre-set for a particular groundwater extraction well or a group of groundwater extraction wells. It may also be appreciated that aquifer objective inputs can be adjusted at 212, or when aquifer objective inputs are changed by the operator.

At 214, the method includes generating a pump operation signal, based on the well operational data and the aquifer objective input. The method 200 may further include sending the pump operation signal to the GUI for display at 216. The pump operation signal may include a pump operation advisory message to inform an operator of a recommended pump procedure, and may indicate preferable actions for the operator to carry out. For example, the recommended pump procedure may include a recommended well operation, and/or a well service procedure including one or more of a well cleaning and a pump impeller servicing. The advisory message may also inform a well operator of operating conditions exceeding established operating thresholds, as discussed above.

The method 200 may alternatively or additionally include adjusting operation of at least one groundwater extraction well based on the pump operation signal, at 218. For example, at 218, a pump rate of the at least one groundwater extraction well may be adjusted when the well efficiency of the at least one groundwater extraction well is below a predetermined low threshold. Where step 218 is carried out, the associated pump operation signal may be an adjusting signal for carrying out said adjusting. It may further be appreciated that adjusting the operation of groundwater extraction wells may include shutting off and/or turning on one or more groundwater extraction wells. Furthermore, said adjusting may occur in real-time, during collection of aquifer data. The adjusting at 218 may be carried out programmatically according to predetermined rules programmed into analysis program 120, or may require an "opt-in" authorization by the well operator to be carried out. Further a combination of programmatic adjustment and operator authorized adjustment (e.g., a semi-automated adjustment) may be employed depending on a determined criticality level of the adjusting operation, so that only the most critical operations require operator authorization.

Figure 3:
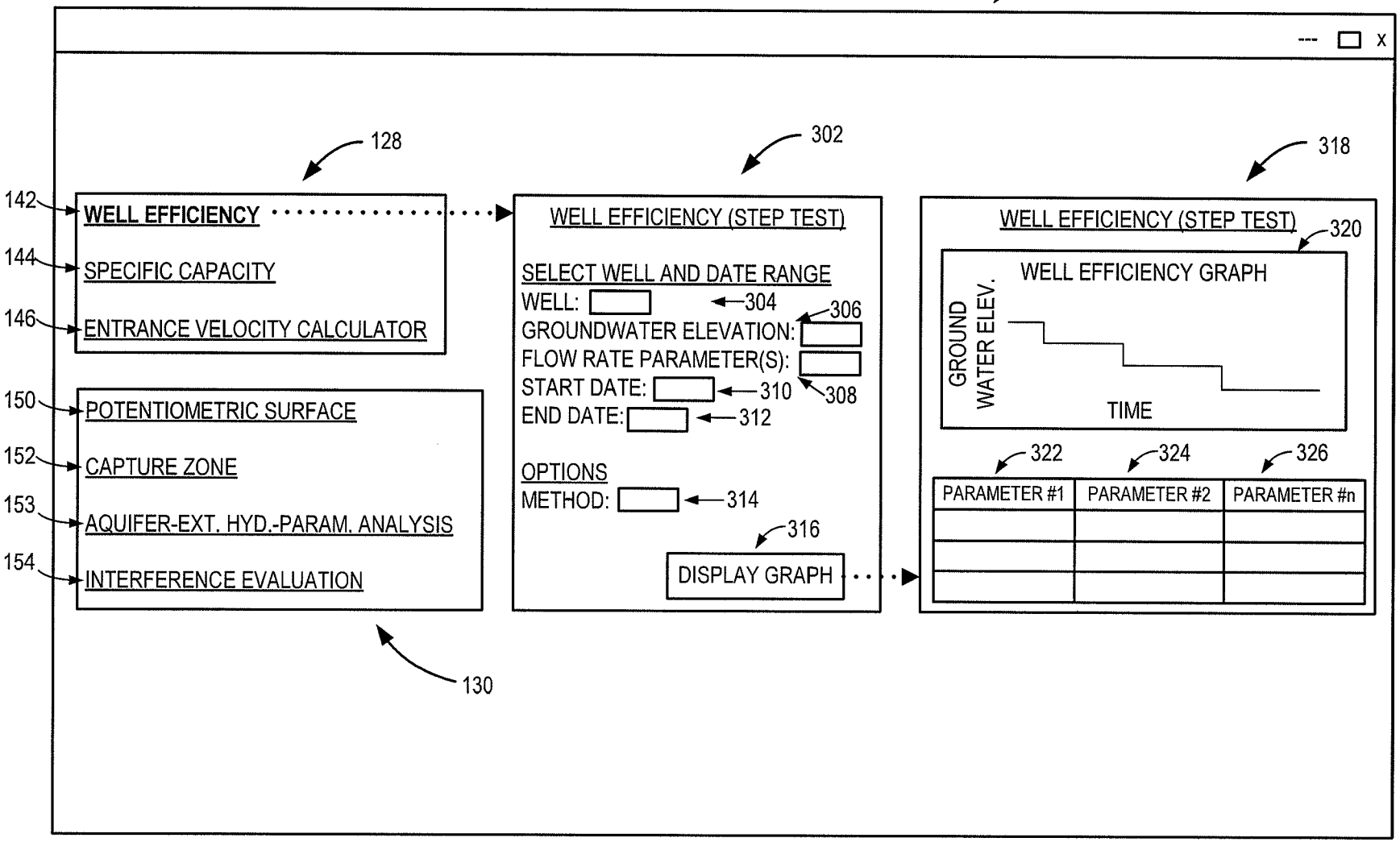
FIG. 3 is a schematic view of a graphical user interface of the system of FIG. 1, illustrating an efficiency module screen.

Referring now to FIG. 3, a screen of an exemplary GUI 124 for carrying out the method 200, for example, is illustrated. A well hydraulics module 128 is graphically presented and may allow an operator to select one of the efficiency module 142, the specific capacity module 144, and the entrance velocity module 146 by traversal of a cursor, for example. Similarly, the hydrogeology module 130 is graphically presented and can allow the operator to select from a number of geostatistical modeling modules, such as the potentiometric surface module 150, the water-flow modeling module (e.g., "capture zone") 152, an aquifer-extraction hydraulic-parameters analysis module 153, and the interference evaluation module 154.

FIG. 3 specifically illustrates a GUI wherein the efficiency module 142 is selected. Upon selection of the efficiency module 142, a well efficiency pane 302 is presented (as indicated by the left-most, dotted arrow). The well efficiency pane 302 is configured to receive efficiency operator input, such as a well 304, a groundwater elevation 306, one or more flow rate parameters 308, a start date 310 and end date 312 to define a date range, and an analysis method 314, via operator input at various input fields. Upon traversal of a "Display graph" button 316, a graphing pane 318 may be presented in the same screen, in this example. In another example, the graphing pane 318 may be presented in a new window or screen. The presentation of said graphing pane 318 is indicated by the right-most, dotted arrow. In graphing pane 318, a well efficiency graph 320 and one or more of aquifer data and analyzed aquifer data parameters may also be presented, as a plurality of measurements over a time period. For example, parameter #1 322 may be a well efficiency, parameter #2 324 may be an aquifer-water pressure loss, parameter #N 326 may be a well-water pressure loss. Other parameters that may be displayed include groundwater elevation, location identifier, time and/or date range of the data associated with the graph, etc.

It may be appreciated that each of the modules contained in the well hydraulics module 128 and hydrogeology module 130 may be selectable by an operator, and upon selection, one or more associated panes may be presented to the operator for receiving operator input and presenting aquifer data and analyzed aquifer data. Interactive graphs may be displayed, such that an operator may further specify data points of interest as operator input to the system, via selection of data points of a graph by traversal of a mouse, for example.

Figure 4:
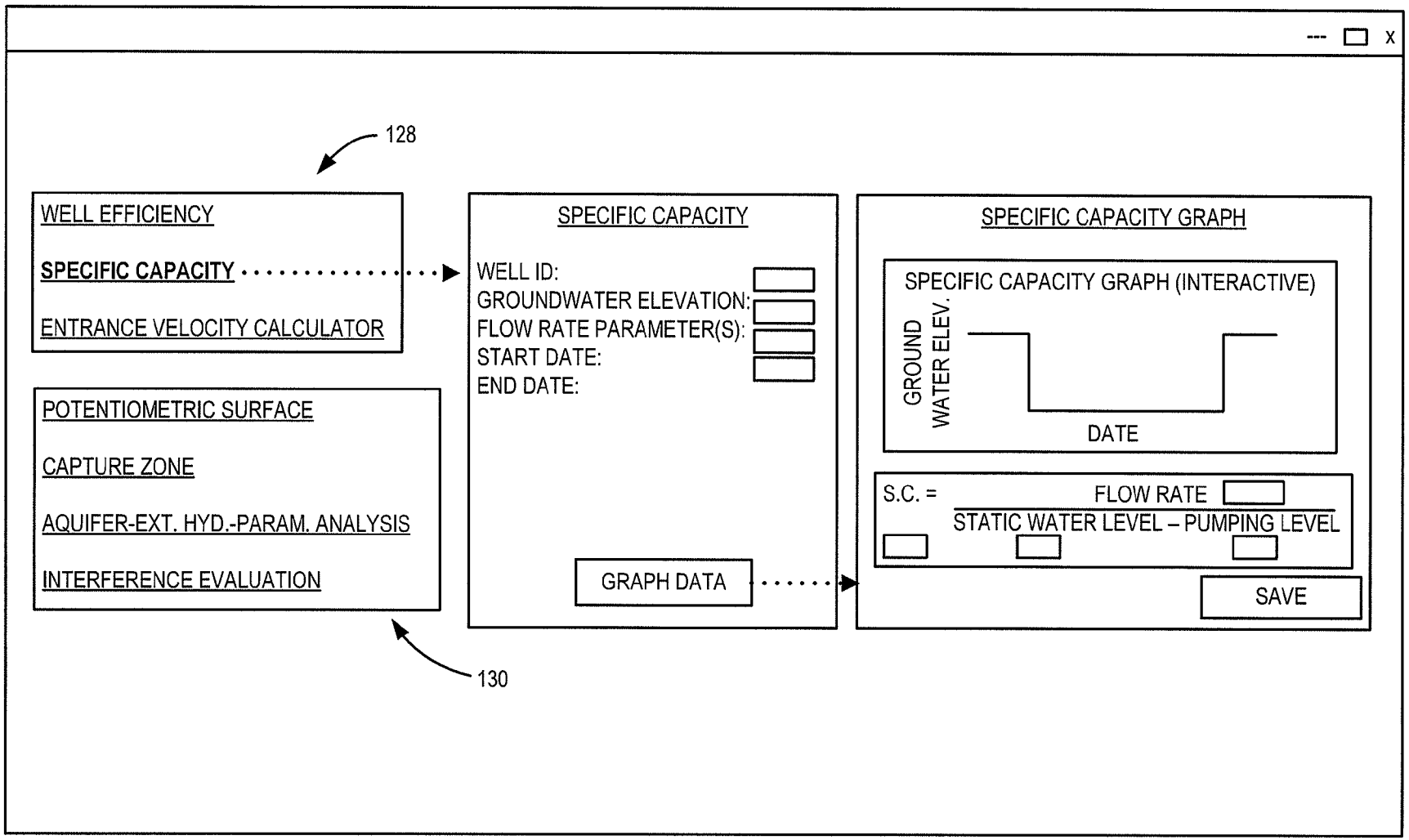
FIG. 4 is a schematic view of a graphical user interface of the system of FIG. 1, illustrating a specific capacity module screen.

Referring now to FIG. 4, a screen is illustrated wherein the specific capacity module 144 has been selected. Accordingly, a specific capacity pane is presented with various input fields, for receiving operator input. Upon selection of a "Graph data" button, a specific capacity graph pane may be presented in the same screen, or in another example, in a separate screen. A specific capacity graph contained therein may be interactive, such that a user can select data points from the graph as operator input. A specific capacity formula pane contained below the specific capacity graph is also configured to receive operator input via input fields. Data can be saved by traversal of the "Save" button.

Figure 5B:
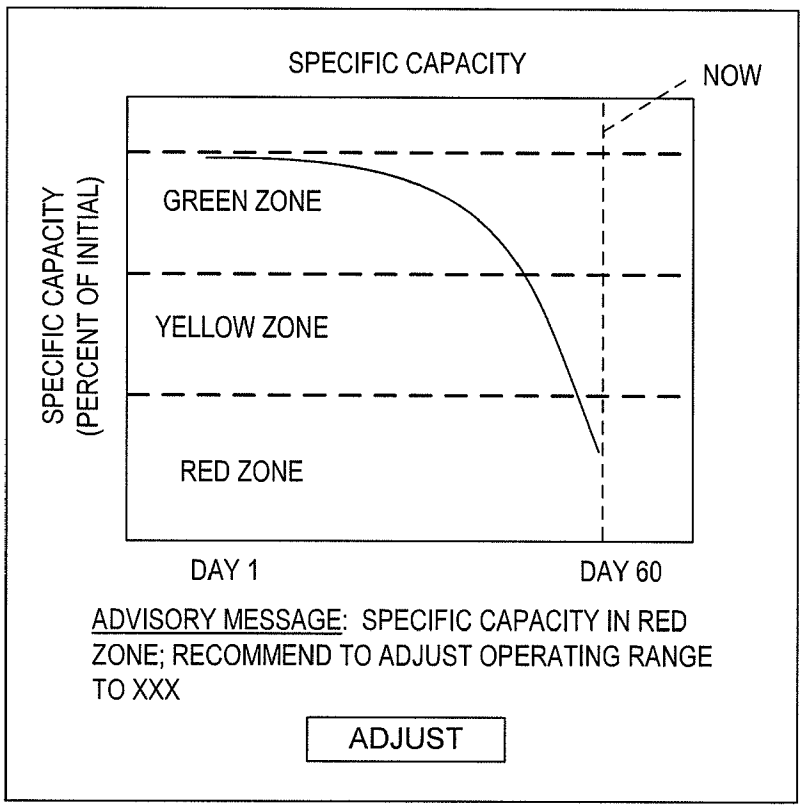
FIG. 5*b* is a graph of specific capacity that may be displayed on the graphical user interface of the system of FIG. 1.
Figure 5A:
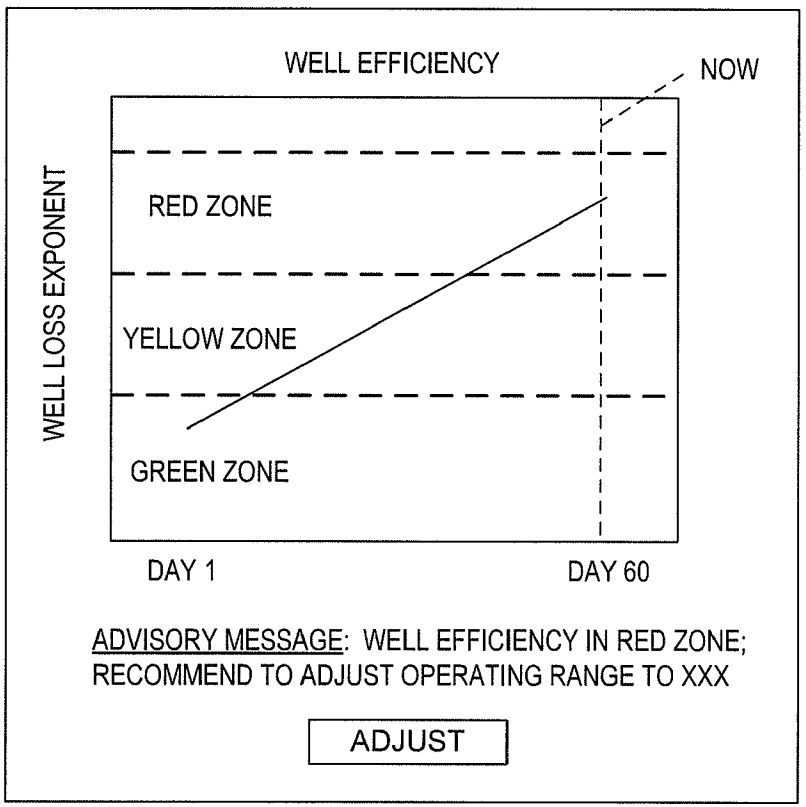
FIG. 5*a* is a graph of well efficiency that may be displayed on the graphical user interface of the system of FIG. 1.

FIGS. 5*a* and 5*b* illustrate exemplary pump operation advisory messages as color ranges associated with a quality of pump operation. As discussed earlier, pump operation advisory messages of varying priority levels, such as a high, medium, and low priority, may be indicated by colors (red, yellow, and green), etc.

Specifically, FIG. 5*a* illustrates a graph of well efficiency, with a well loss exponent on the y-axis over a selectable or default period of time (e.g., 60 days) on the x-axis. In some cases, the period of time may end at the current moment, as shown, enabling an operator to view current conditions as well as a recent history. In the depicted graph, when the well loss exponent is small, well loss is low and operation is in a green zone, where operation in the green zone is associated with pump operation of good efficiency. Toward the center of the x-axis, the well loss exponent increases and enters a yellow zone, associated with pump operation of fair efficiency. Toward day 60, which may be now, the well loss exponent enters a red zone associated with poor pump operation. It will be appreciated that each zone of operation carries with it corresponding lower and upper thresholds used to determine whether the pump operation parameter, in this case well efficiency, is within the zone. Thus, when such a well efficiency graph is presented with the pump operation color ranges, it can be easily understood that a pump service or an adjustment to pump operation may be desirable when pump operation is in a yellow or red zone. In some examples, an additional pump advisory message indicating a desired operator action may be presented. In the depicted embodiment of FIG. 5*a*, a pump advisory message indicating a current pump operation status (specific capacity in red zone), as well as a recommended action is displayed. A selector, labeled "adjust" in FIG. 5*a*, may also be displayed to enable the user to choose to undertake the recommended action, e.g., adjust pump operation range to a recommended parameter.

Similarly, FIG. 5*b* illustrates specific capacity as a percentage of initial specific capacity on the y-axis over a selectable or default period of time (e.g., 60 days) on the x-axis. In this example, the specific capacity decreases non-linearly, passing from a green zone, through a yellow zone to a red zone. When specific capacity is high relative to an initial value, pump operation is good and thus in the green zone. When specific capacity is low relative to an initial value, pump operation is poor and is thus in the red zone. Accordingly, from this graph, it can be easily understood by an operator that a pump service or an adjustment to pump operation may be necessary when pump operation is in a yellow or red zone. In some examples, an additional pump advisory message indicating a desired operator action may be presented. Like in FIG. 5*a*, in FIG. 5*b*, a pump advisory message is displayed indicating that the specific capacity is currently in the red zone. The pump advisory message may include a recommended action, such as adjust pump operation range to a recommended parameter. A selector also may be displayed to enable the user to take the recommended action.

It may be appreciated that an operator may request graphs such as the graphs of FIGS. 5*a* and 5*b*, and/or such graphs may be presented automatically when well operational data exceeds a predetermined threshold (e.g., well loss exponent entering a red zone, specific capacity entering a yellow zone).

Figure 6:
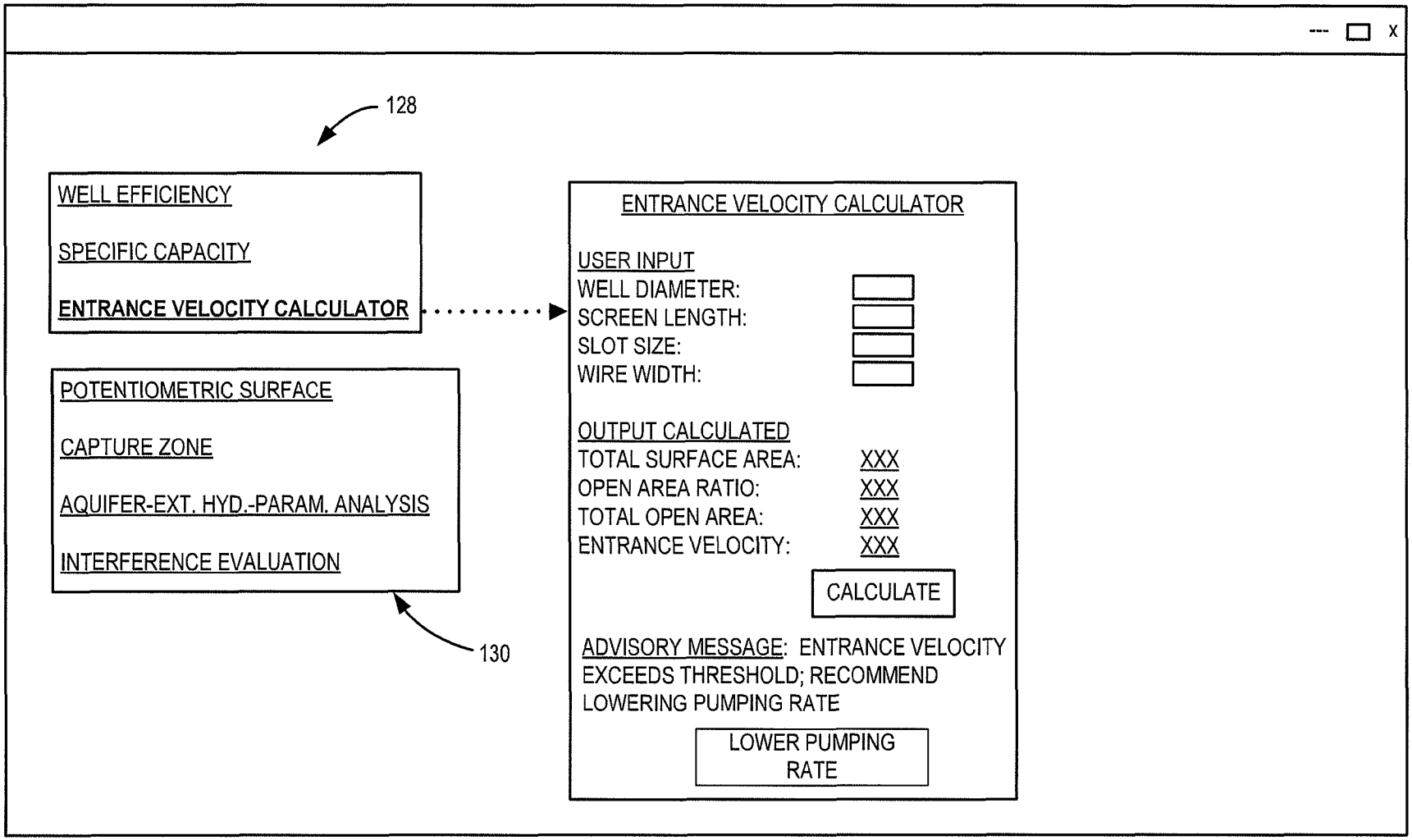
FIG. 6 is a schematic view of a graphical user interface of the system of FIG. 1, illustrating an entrance velocity module screen.

Referring now to FIG. 6, a schematic view of a screen where the entrance velocity module 146 has been selected is illustrated. Here, an entrance velocity calculator pane is presented, with various input fields for receiving operator (e.g., user) input (e.g., well diameter, screen length, slot size, wire width, etc.). Upon traversal of a "Go" button, various output parameters (e.g., total surface area, open area ratio, total open area, entrance velocity, etc.) are calculated and displayed in the entrance velocity calculator pane.

Figure 7:
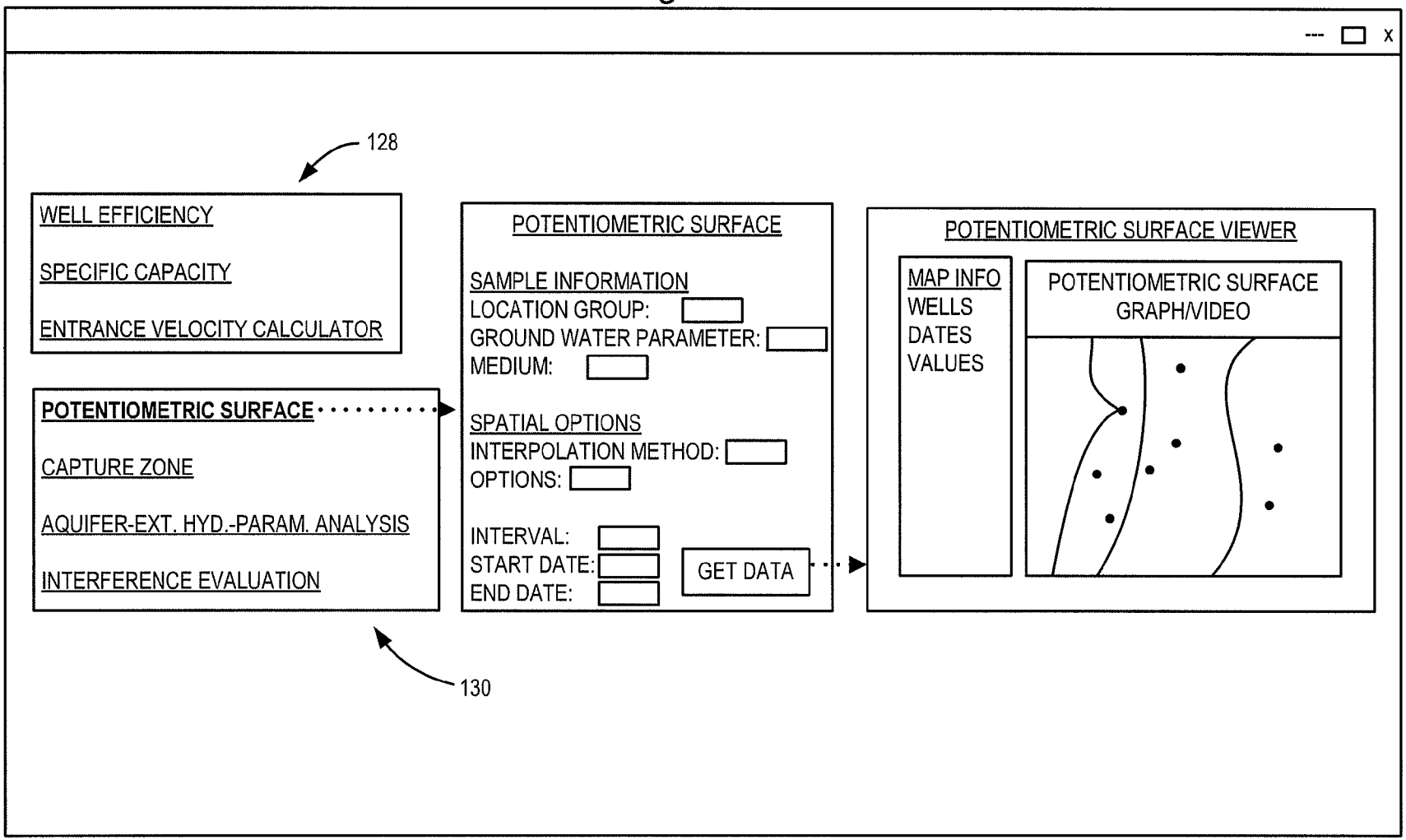
FIG. 7 is a schematic view of a graphical user interface of the system of FIG. 1, illustrating a potentiometric surface module screen.

FIG. 7 shows a schematic view where the potentiometric surface module 150 of the hydrogeology module 130 has been selected. Upon selection of the potentiometric surface module 150, a potentiometric surface pane is presented, as indicated by the left-most, dotted arrow. Various input fields are provided in the potentiometric surface pane for operator input (e.g., location group, ground water parameters, medium, interpolation method, options, interval, start date, end date, etc.) Upon traversal of a "Get data" button, a potentiometric surface viewer pane may be presented in the same screen or a different screen. The potentiometric surface viewer may include a graph and/or video indicating two-dimensional or 3-dimensional changes in the potentiometric surface. The location of sites (illustrated as small dark circles) in the aquifer may be displayed in the graph and/or video. Further, potentiometric surface map information is calculated upon traversal of the "Get data" button, such that values of various water measurements of corresponding wells and dates can be viewed in the potentiometric surface viewer pane.

Figure 8B:
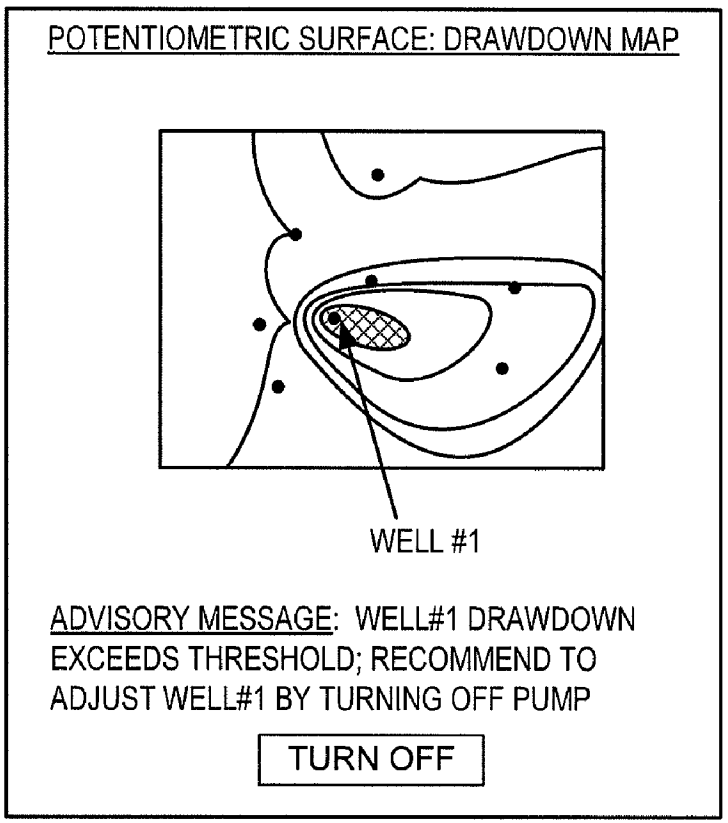
Figure 8A:
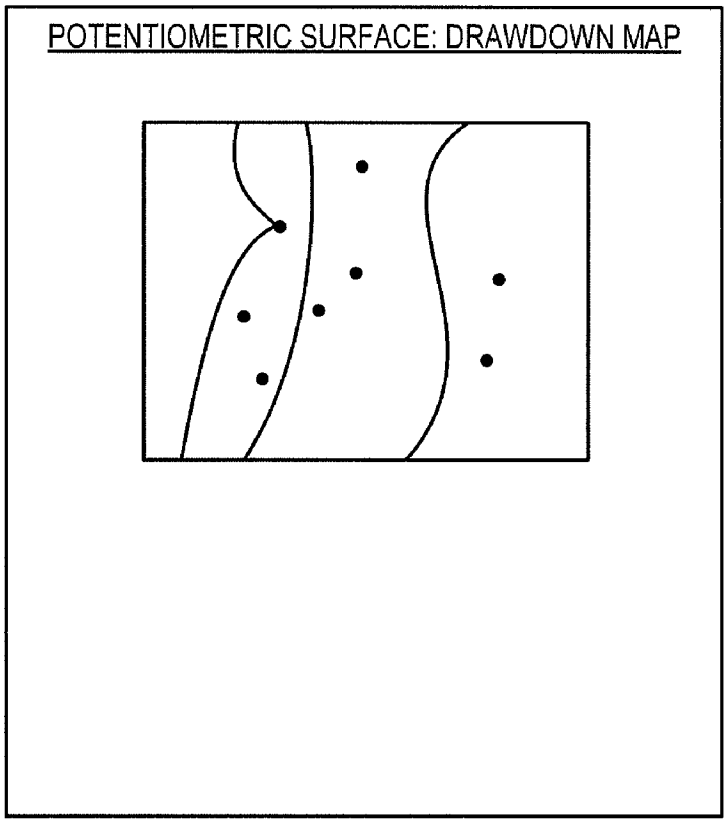
FIG. 8*a* illustrates an exemplary potentiometric surface graph where contour lines delineate areas associated with differing drawdown values, when none of the depicted wells are pumping water.

FIGS. 8*a* and 8*b* illustrate two exemplary potentiometric surface graphs where contour lines delineate areas associated with differing drawdown values. For example, FIG. 8*a* illustrates groundwater flow when none of the wells (shown as dark circles) are pumping water. In contrast, FIG. 8*b* illustrates groundwater flow when well #1 is turned on. It can be appreciated that drawdown may become great at the center of well #1, in such a case. In some examples, an extreme drawdown situation (i.e., when the drawdown is determined to be greater than a predetermined threshold) may be graphically indicated, for example by hatching or changes in color of a region of a potentiometric surface graph, as shown by the hatched ellipse of FIG. 8*b*. In such a case, a pump advisory message may be automatically presented to an operator, as shown. The pump advisory message may include a message indicating an operational status of the pump (e.g., excessive drawdown is occurring), and may also include a recommended action, such as turn off pump. Further, a selector may be provided to enable the user to take the recommended action.

It will be appreciated that drawdown graphs can be presented as still images, and/or as videos, such that the drawdown can be visualized over a specified interval, and/or in real-time. Graphs such as those of FIGS. 8*a* and 8*b* may be presented responsive to a request by an operator and/or automatically when drawdown, or other water measurements exceed predetermined thresholds.

Figure 9:
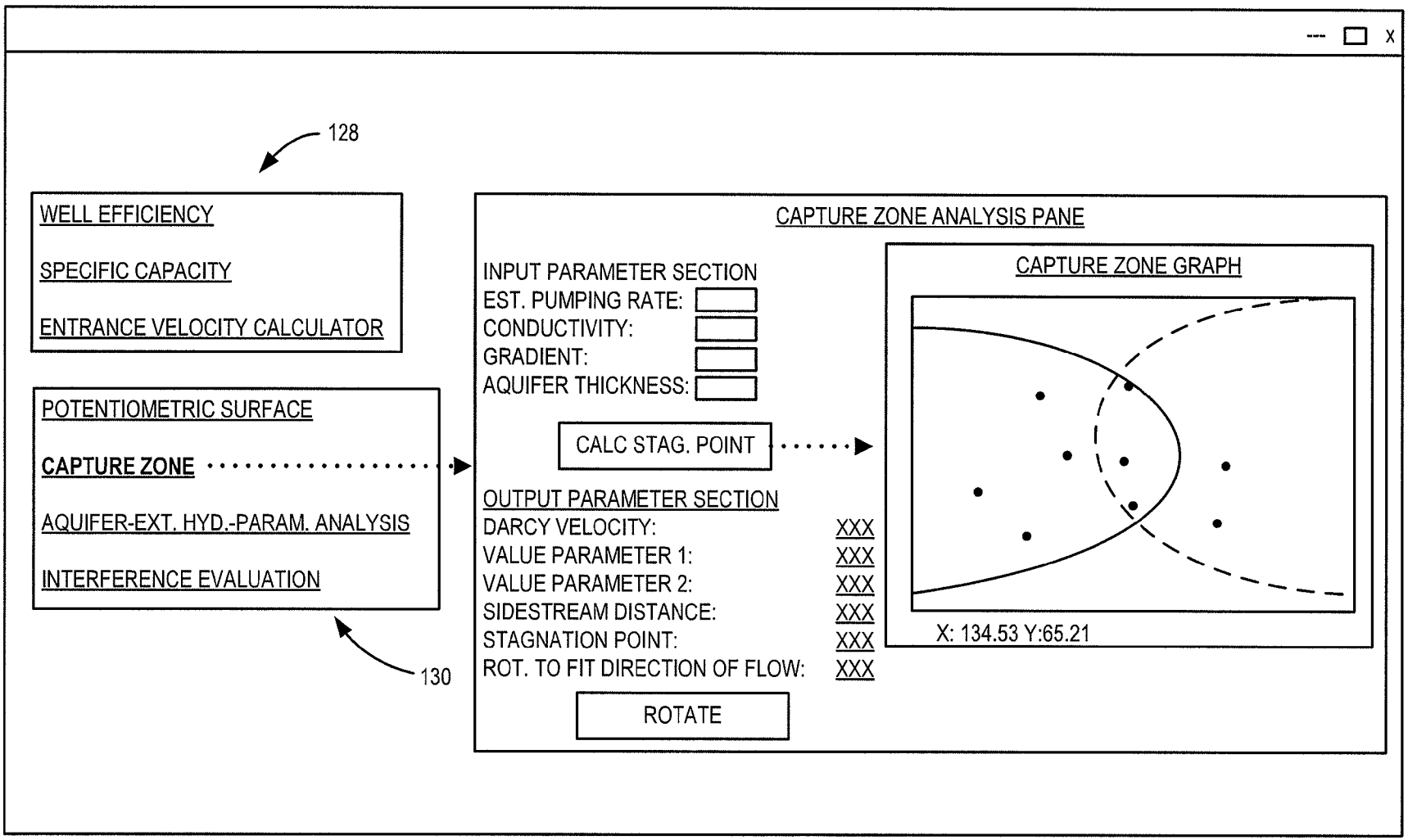
FIG. 9 is a schematic view of a graphical user interface of the system of FIG. 1, illustrating a water-flow modeling module screen, which shows a groundwater extraction well capture zone.

FIG. 9 shows a schematic view where the water-flow modeling module ("groundwater extraction well capture zone") 150 of the hydrogeology module 130 has been selected. Here, a groundwater extraction well capture zone analysis pane is presented, including a capture zone graph. The capture zone analysis pane also may include an input parameter section with various input fields for receiving operator input. Upon traversal of a "Calculate stagnation point" button, one or more stagnation point values for one or more capture zones may be calculated. Further, various output parameters are calculated and displayed under the output parameter section. Upon traversal of a "Rotate" button, the capture zone graph may be rotated to fit a direction of water flow.

Figure 10:
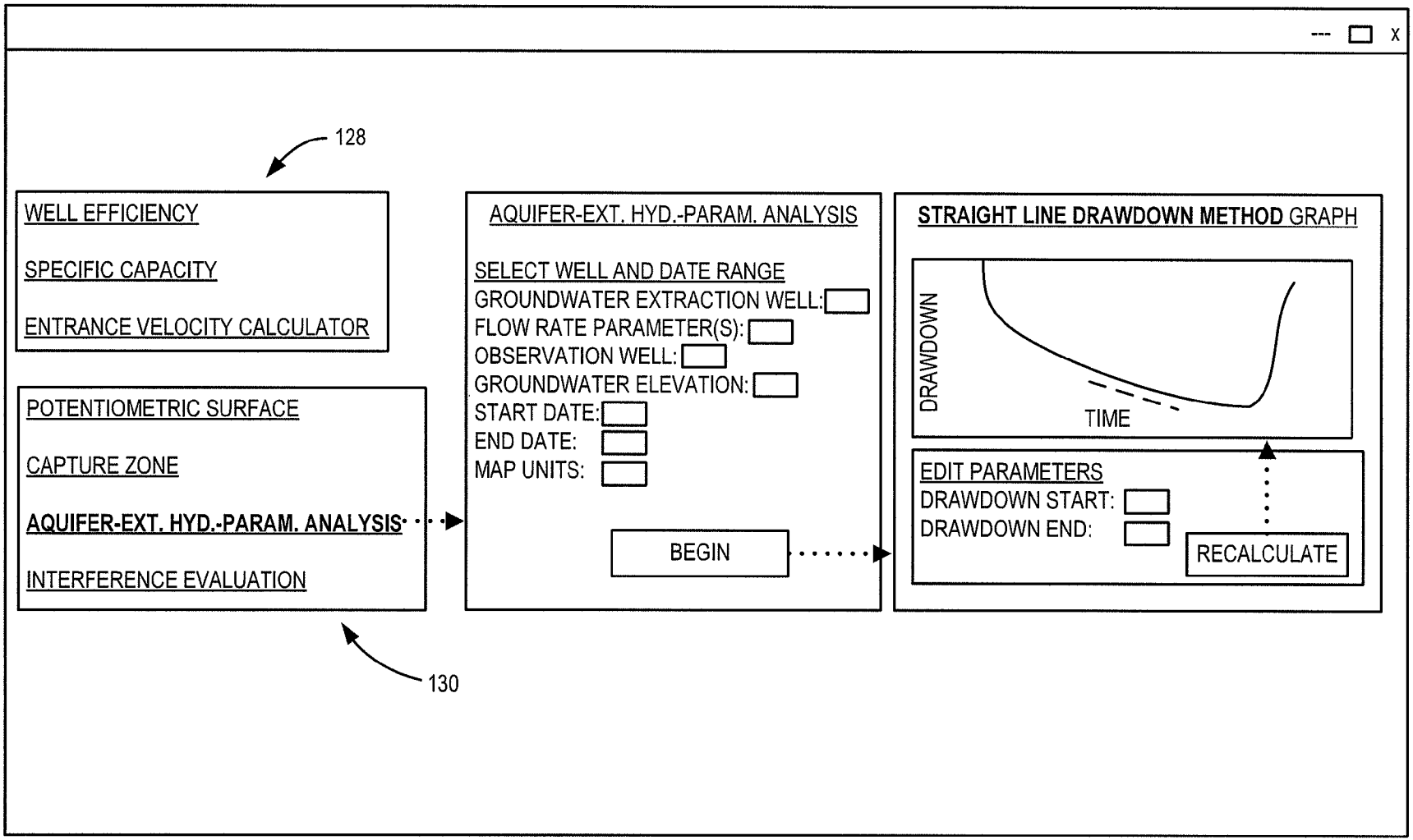
FIG. 10 is a schematic view of a graphical user interface of the system of FIG. 1, illustrating an aquifer-extraction hydraulic-parameters analysis module screen.

FIG. 10 shows a schematic view where an aquifer-extraction hydraulic-parameters analysis module 153 of the hydrogeology module 130 has been selected. A aquifer-extraction hydraulic-parameters analysis pane may be presented to the user, with various input fields by which a user can select groundwater extraction wells to be included in the analysis, as well as a time interval for analysis. Upon traversal of a "Begin" button, a aquifer-extraction hydraulic-parameters analysis graph pane may be presented, in this example. An operator may interact with a drawdown graph included therein to select a portion of the drawdown graph for use as an operator input for the analysis of the drawdown data. Further, the operator may edit parameters, such as the drawdown start and a drawdown end, and traverse a "Recalculate button" to trigger a recalculation of drawdown values.

Figure 11:
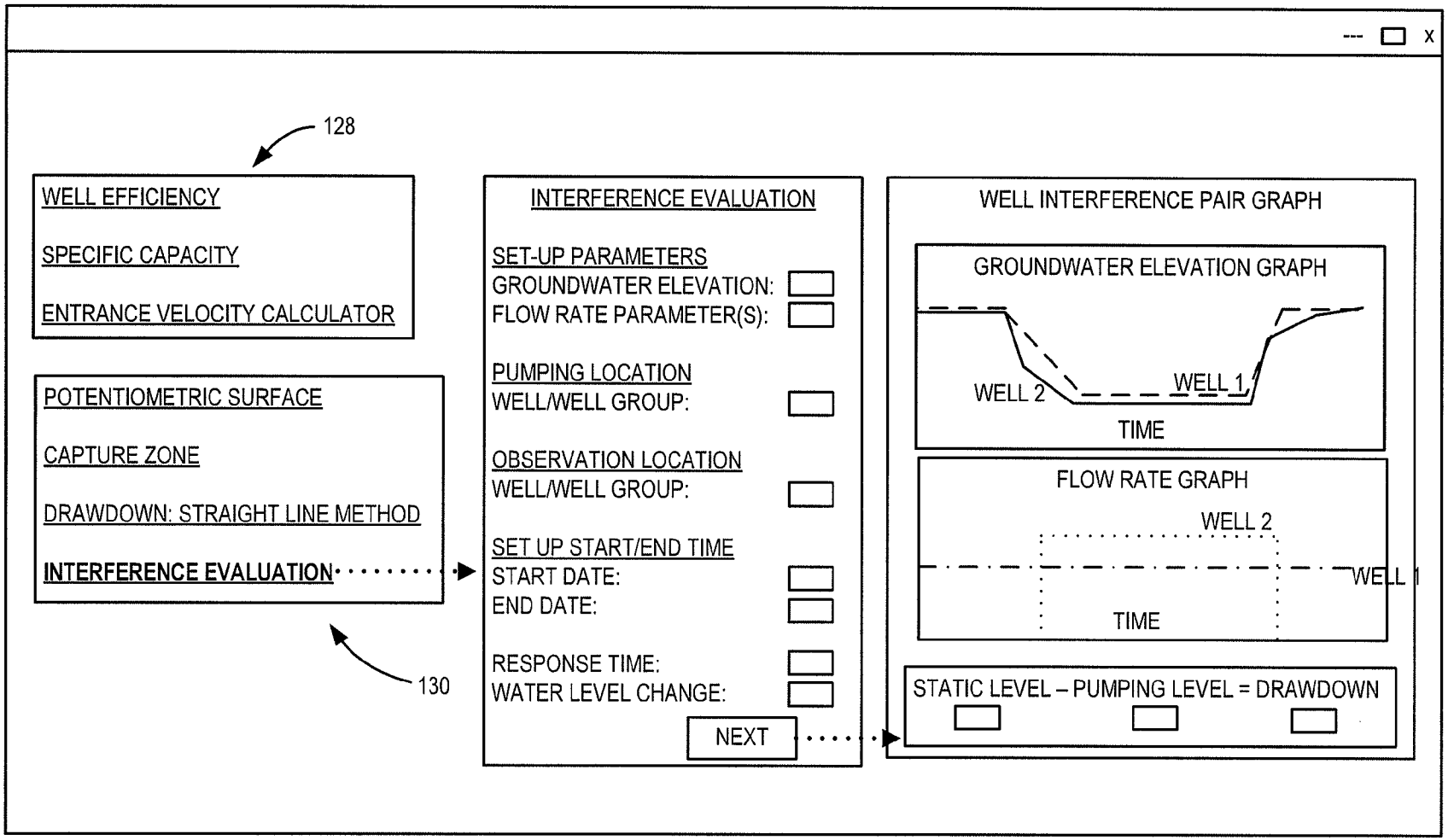
FIG. 11 is a schematic view of a graphical user interface of the system of FIG. 1, illustrating an interference evaluation module screen.

Finally, FIG. 11 shows a schematic view where the interference evaluation module 154 of the hydrogeology module has been selected. Upon selection, an interference evaluation pane is presented, in this example. Here, an operator can fill in various input fields, including set-up parameters, pumping location, observation well location (e.g., a groundwater extraction well at which the interference evaluation is being performed), and start and end times for analysis of well interference. Traversal of a "Next" button will cause a well interference pair graph to be presented, in the same screen or in a different screen. In the well interference pair graph, two subgraphs are presented. These two graphs illustrate, respectively, groundwater elevation and a flow rate for the two or more selected wells. In this example, it can be observed from the flow rate graph that when well 2 is turned on, the groundwater elevation decreases for both well 1 and well 2. Thus, an operator can visually comprehend the effects of operating a first well on a second well, using this graphical user interface. Further, a drawdown parameter can be calculated, automatically, semi-automatically, or manually by operator input in input fields, as indicated by the formula located underneath the flow rate graph.

It will be understood that the above described systems and methods may also be applied to aquifers with pumping stations that pump water into the aquifer to change the hydrogeologic conditions of the aquifer. Therefore, any of the extraction wells discussed herein may be equipped with intake and outflow capabilities. For example, in the potentiometric surface graph of FIG. 8*b*, the system may be configured to determine ground water pressure at the point of injection and determine whether such pressure exceeds a predetermined threshold. An advisory message may indicate this to the operator, and include a recommended action, such as maintaining the well to remove siltation of the well screen. A selector may be provided to take the recommended action and reverse water flow to remove siltation from the well screen, for example.

It will be appreciated that the computing devices described herein may be any suitable computing device configured to execute the programs described herein. For example, the computing devices may be a mainframe computer, personal computer, laptop computer, portable data assistant (PDA), computer-enabled wireless telephone, networked computing device, or other suitable computing device, and may be connected to each other via computer networks, such as the Internet. These computing devices typically include a processor and associated volatile and non-volatile memory, and are configured to execute programs stored in non-volatile memory using portions of volatile memory and the processor. As used herein, the term "program" refers to software or firmware components that may be executed by, or utilized by, one or more computing devices described herein, and is meant to encompass individual or groups of executable files, data files, libraries, drivers, scripts, database records, etc. It will be appreciated that computer-readable media may be provided having program instructions stored thereon, which upon execution by a computing device, cause the computing device to execute the methods described above and cause operation of the systems described above.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A method for managing aquifer operation, the method comprising:

receiving at an analysis computing device, one or more water measurements from a plurality of sites in an aquifer, wherein water measurements are received at a plurality of time points, and wherein a site includes one or more groundwater extraction wells;

calculating well operational data for at least one groundwater extraction well based on the water measurements, wherein the well operational data includes well efficiency over a time period, wherein calculating the well operational data includes executing a well hydraulic interference evaluation of two or more groundwater extraction wells based on geographic reference coordinates, the executing including calculating a well interference based on a number of operator inputs received from a graphical user interface and based on the plurality of water measurements received from the two or more groundwater extraction wells;

receiving an aquifer objective input via the graphical user interface presented on the analysis computing device;

generating a pump operation signal based on the well operational data and the aquifer objective input.

2. The method of claim 1, further comprising adjusting operation of at least one groundwater extraction well based on the pump operation signal.

3. The method of claim 2, wherein adjusting operation of at least one groundwater extraction well includes adjusting a pump rate of the at least one groundwater extraction well when the well efficiency of the at least one groundwater extraction well is below a predetermined low threshold.

4. The method of claim 1, further comprising sending the pump operation signal to the graphical user interface for display, wherein the pump operation signal includes a pump operation advisory message to inform an operator of a recommended pump procedure.

5. The method of claim 1, wherein receiving the aquifer objective input includes receiving the aquifer objective input from the graphical user interface associated with the analysis computing device, and wherein the aquifer objective input is one or more of: an optimal energy consumption, an optimal groundwater elevation for one or more sites, an optimal pressure reading for one or more sites, an optimal water pumping volume, a site contamination avoidance for a selected site, and a groundwater contamination removal for the aquifer.

6. The method of claim 1, wherein the plurality of time points is one or more of: a plurality of time points collected according to a predetermined schedule to continuously monitor the water measurements, and a plurality of time points collected in response to a change in one or more water measurements exceeding an associated threshold.

7. The method of claim 1, wherein calculating the well operational data further includes calculating one or more of: an aquifer-water pressure loss, a well-water pressure loss, a specific capacity, and an entrance velocity.

8. The method of claim 1, wherein the analysis computing device includes a remote access terminal configured to display the graphical user interface to a user over a computer network.

9. A system for managing aquifer operation, the system comprising:

an analysis computing device configured to receive aquifer data including one or more water measurements from a plurality of sites over a time interval and perform analyses on the aquifer data, wherein a site includes one or more groundwater extraction wells, wherein the analyses on the aquifer data include calculating a well efficiency of one or more groundwater extraction wells over a time interval at the analysis computing device, and wherein a well efficiency calculation includes calculating an intermediate well efficiency, executing an interference evaluation of at least two groundwater extraction wells, and modifying the intermediate well efficiency based on the interference evaluation from the at least one additional groundwater extraction well; and a graphical user interface presented on a display associated with the analysis computing device, the graphical user interface including:

a well hydraulics module configured to graphically present hydraulics data, and a hydrogeology module configured to graphically present hydrogeological data, wherein the graphical user interface is configured to receive operator input, send the operator input to an analysis program of the analysis computing device, display aquifer data received from the analysis computing device, display analyzed aquifer data received from the analysis computing device, and display a pump operation signal including a pump operation advisory message received from the analysis computing device.

10. The system of claim 9, wherein the well hydraulics module includes an efficiency module configured to receive efficiency operator input including one or more selected groundwater extraction wells and a time interval, send a well operational data request to the analysis computing device, receive well operational data from the analysis computing device, and display the well operational data, wherein the well operational data includes aquifer-water pressure loss, well-water pressure loss, and well efficiency for the one or more selected groundwater extraction wells.

11. The system of claim 9, wherein the well hydraulics module includes a specific capacity module configured to receive specific capacity operator input including one or more selected groundwater extraction wells, a static water level, an interference water level, and a pumping water level, send the specific capacity operator input to the analysis computing device, receive a calculated specific capacity for the one or more selected groundwater extraction wells from the analysis computing device, and display the calculated specific capacity for the one or more selected groundwater extraction wells.

12. The system of claim 9, wherein the well hydraulics module includes an entrance velocity module configured to receive entrance velocity operator input including one or more selected groundwater extraction wells and selected groundwater extraction well parameters, send an entrance velocity request to the analysis computing device, receive an entrance velocity for the one or more selected groundwater extraction wells from the analysis computing device, and display the entrance velocity for the one or more selected groundwater extraction wells.

13. The system of claim 9, wherein the hydrogeology module includes one or more geostatistical modeling modules configured to display aquifer-water pressure data including elevation units, and apply one or more geostatistical models to the aquifer-water pressure data.

14. The system of claim 13, wherein the geostatistical modeling module is a potentiometric surface module configured to receive potentiometric surface operator input including a plurality of sites, a time interval, and a desired geostatistical interpolation method, wherein the desired geostatistical interpolation method is one of a linear-log kriging method, an inverse-distance weighted method, a spline method, a universal kriging method, and an ordinary kriging method, send the potentiometric surface operator input to the analysis computing device, receive a potentiometric surface model from the analysis computing device based on the potentiometric surface operator input, and display the potentiometric surface model in a geographic rendering system.

15. The system of claim 13, wherein the geostatistical modeling module is a water-flow modeling module configured to:

receive water-flow modeling operator input including one or more of a selected groundwater extraction well, a location of water-flow traces, a number of water-flow traces, and a starting point for each water-flow trace from the graphical user interface, receive an aquifer transmissivity input from one or more of the graphical user interface and the analysis computing device, send the water-flow modeling operator input and the aquifer transmissivity input to the analysis computing device, receive a groundwater-extraction-well capture-zone analysis including modeled water-flow traces for the one or more selected groundwater extraction wells from the analysis computing device based on the water-flow modeling operator input and the water transmissivity input, display the modeled water-flow traces, wherein the modeled water-flow traces are computed based on an interpolated pressure field, the water-flow modeling operator input, and the water transmissivity input.

16. The system of claim 13, wherein the geostatistical modeling module is an interference evaluation module configured to receive interference operator input including at least two groundwater extraction wells, send the interference operator input to the analysis computing device, receive an interference evaluation from the analysis computing device based on the interference operator input, and graphically display the interference evaluation.

17. The system of claim 9, further comprising a remote access terminal connected to the analysis computing device, wherein the remote access terminal is configured to receive preprocessed aquifer data and analyzed aquifer data from the analysis computing device, and wherein the graphical user interface is further configured to display preprocessed aquifer data via the remote access terminal, display analyzed aquifer data via the remote access terminal, and display a pump operation advisory message via the remote access terminal.

18. A method for managing aquifer operation, the method comprising:

receiving at an analysis computing device, one or more water measurements from a plurality of groundwater extraction wells in an aquifer, wherein water measurements are received at a plurality of time points;

calculating a well efficiency for each of the plurality of groundwater extraction wells based on the water measurements, wherein the calculating includes:

executing an interference evaluation of at least two groundwater extraction wells, and calculating the well efficiency for each groundwater extraction well based on the interference evaluation and a number of efficiency operator inputs received at a graphical user interface associated with the analysis computing device;

receiving an aquifer objective input from the graphical user interface;

generating a pump operation signal including a pump operation advisory message based on the well operational data and the aquifer objective input;

sending the pump operation advisory message to the graphical user interface; and adjusting operation of at least one groundwater extraction well based on the pump operation signal.

* * * * *